United States Patent [19]

Hillis

[11] 4,423,919

[45] Jan. 3, 1984

[54] ELECTRICAL CONNECTOR

[75] Inventor: Frank M. Hillis, Franklin, N.Y.

[73] Assignee: The Bendix Corporation, Southfield, Mich.

[21] Appl. No.: 365,708

[22] Filed: Apr. 5, 1982

[51] Int. Cl.[3] ..... H01R 13/648

[52] U.S. Cl. ..... 339/143 R; 339/14 R

[58] Field of Search ..... 339/143, 14; 29/725, 29/753

[56] References Cited

U.S. PATENT DOCUMENTS

| | | | |
|---|---|---|---|
| 3,144,292 | 8/1964 | Forney | 339/143 R |
| 3,551,880 | 12/1970 | Hartwell | 339/89 M |
| 3,897,125 | 7/1975 | Anderson | 339/143 R |
| 4,007,953 | 2/1977 | Powell | 339/89 R |
| 4,248,492 | 2/1981 | Snyder | 339/143 R |

*Primary Examiner*—Eugene F. Desmond

*Assistant Examiner*—David L. Pirlot

*Attorney, Agent, or Firm*—Charles D. Lacina

[57] ABSTRACT

An improved electrical connector of the type having a cylindrical shell 22 having a radial flange portion 26, a longitudinal key portion 29 and a frequency shielding ring 49 sized to fit over the shell and mount adjacent to the flange portion, characterized by one of the portions having a keyway 50 having a pair of abutment faces 51, 53 and the shielding ring including a detent portion 46 having a pair of spaced end faces 47, 49, a first of the end faces being configured to abut the first of the abutment faces and the second of the end faces being configured to abut the second of the abutment faces when the detent portion is fit within the keyway, whereby abutting the faces causes the ground ring to be properly oriented on the shell and prevented from rotating relative to the shell.

7 Claims, 9 Drawing Figures

FIG. 1
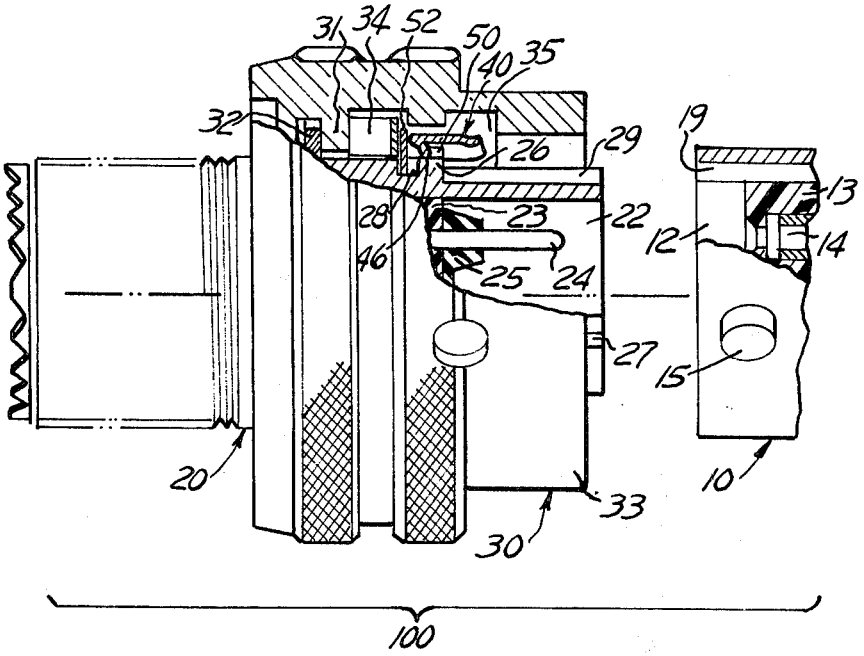
FIG. 2
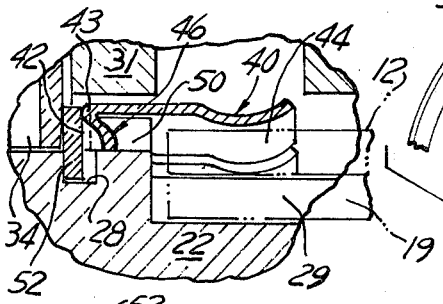
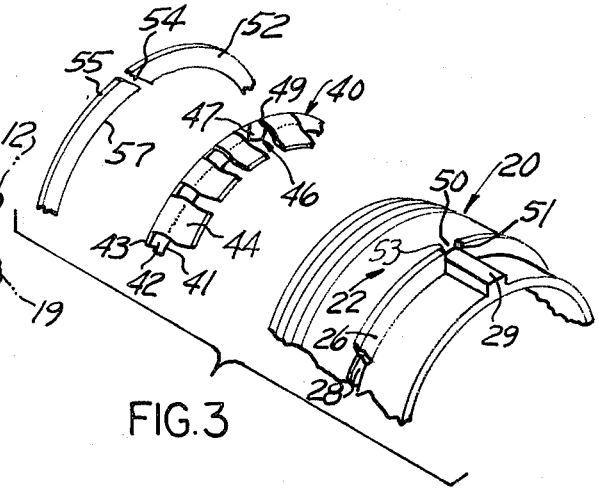
FIG. 3
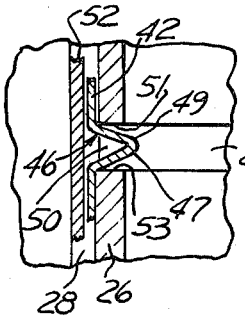
FIG. 4

FIG.5
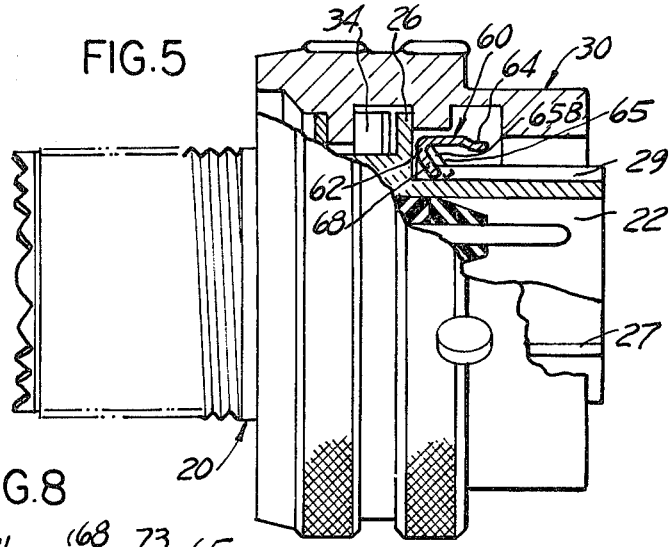
FIG.8
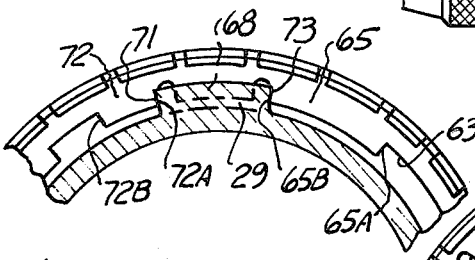
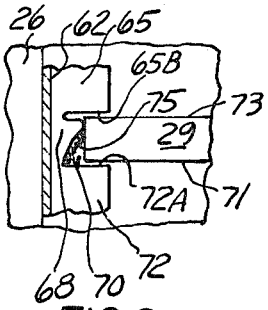
FIG.9
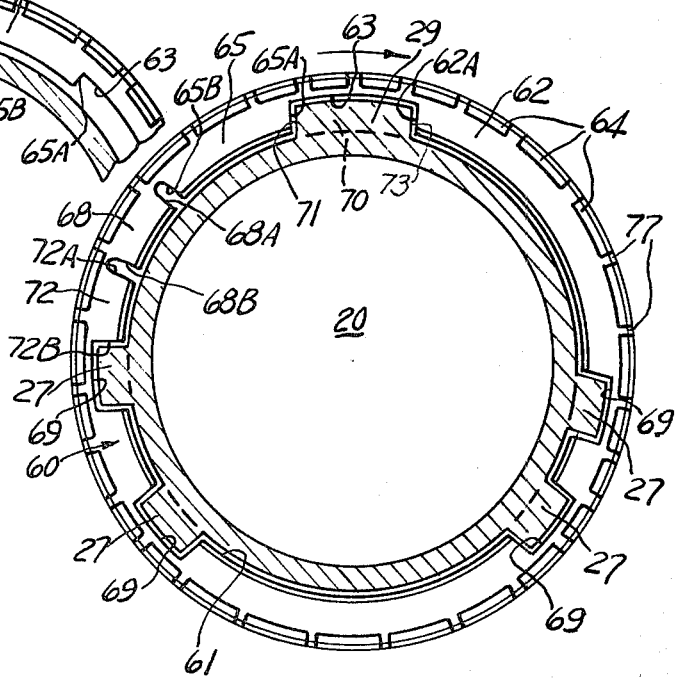
FIG.6
FIG.7
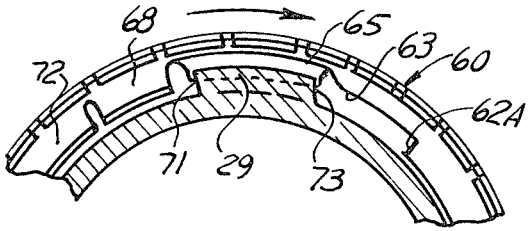

ELECTRICAL CONNECTOR

This invention relates generally to an electrical connector having a shield ring for shielding electrical contacts from radio frequency interference and more particularly to a solderless arrangement for mounting the shield ring about a connector shell.

The use of shielding in electrical connectors to eliminate unwanted radio frequency and electromagnetic signals (RFI/EMI) and electromagnetic pulses (EMP) from interfering with signals being carried by contacts in connectors is known. Previous U.S. Patents disclose annular shields comprised of sheet metal with spaced resilient fingers extending in one longitudinal direction to provide a spring connection between mating shell halves of the electrical connector. Further, some of these shields include a radial band which is received in an annular groove of one shell and the spring fingers of the sheild are spaced circumferentially from each other to circumpose and contact the other shell and complete a ground path.

Presently the shield ring has to be soldered to a plated aluminum plug shell. Soldering a ground ring onto connector shells is time consuming and requires a large amount of rework. Both the initial assembly and rework require labor which adds to product cost. Numerous labor operations are required. The rework is required to repair blistered plating or broken solder joints. Normally, a soldered shield ring is non-repairable if broken in the field. Further, the industry is tending to introduce plastic connector shells which would not lend themselves to being soldered.

Unless a shield ring were provided with means for resisting rotation in its groove, the solder would be subject to shearing forces which could break the soldered joint. Rotation of the shield ring could degrade frequency interference protection.

This invention is intended to remedy these drawbacks. The invention solves the problem of how to mount a shield ring to an electrical connector shell without the need of soldering, welding, brazing, etc., and be mechanically retained.

Advantages offered by this invention are an elimination of soldering as an expedient for terminating a shield ring to a connector shell, provision of an RFI/EMI shield which may be rapidly assembled (or repaired) in the field by semi-skilled technicians, a mechanical mounting which is comparable to a soldered mounting relative to electrical or frequency shield requirements.

DETAILED DESCRIPTION OF THE INVENTION

FIG. 1 is a partial section view of an electrical connector assembly.

FIG. 2 is an enlarged fragment view, in section, of a plug electrical connector shown in FIG. 1.

FIG. 3 shows, in fragment, an RFI/EMI shield ring about to be assembled to the plug shell.

FIG. 4 is a partial plan view in section of the shield ring assembled to the plug shell of FIG. 3.

FIG. 5 is a partial section view of an alternate electrical connector according to this invention.

FIG. 6 is an end view of the electrical connector of FIG. 5 showing an alternate RFI/EMI shield ring fit about the connector forward end for assembly thereto.

FIG. 7 shows the shield ring of FIG. 6 rotated slightly clockwise relative to the plug connector.

FIG. 8 shows the shield ring assembled to the connector.

FIG. 9 is a partial plan view in section of the shield ring of FIG. 8 assembled to the connector of FIG. 5.

Turning now to the drawings, FIG. 1 shows a pair of multi-contact electrical connectors according to the present invention about to be connected together into an electrical connector assembly 100, the electrical connectors comprising a plug (connector member) 20 adapted to mate with a receptacle (connector member) 10. The plug 20 comprises a generally cylindrical barrel or shell 22 which has a front end portion thereof sized to be telescopically received in the front end portion of a generally cylindrical shell 12 forming the receptacle 10. To assure that only desired shells are mated, one or more axially extending alignment keys 27, 29 on the plug shell exterior surface are provided to fit within a like arrangement of axially extending alignment grooves 19 in the interior surface of the receptacle shell, key 29 being wider than keys 27 and serving as a primary orientation key. A plurality of socket and pin contacts 14, 24 are axially positioned in dielectric inserts (i.e., electrical insulators) 13, 23 mounted in the respective connector shells 12, 22, only one of each such contact being illustrated in FIG. 1. An interfacial seal 25 to protect against moisture may be provided on the front face of one or both of the insulators.

The exterior surface of plug shell 22 has an annular groove 28 and a radial flange 26 disposed thereabout. Annular groove 28 is disposed rearwardly of but contiguous to radial flange 26.

An RFI/EMI frequency interference shielding ring (or ground ring) 40 is mounted on plug shell 22 for shielding the mated contacts 14, 24 from RFI/EMI interference when the connector members 10, 20 are mated. A retaining ring 52 is received in annular groove 28 to position shield ring 40 in abutting relation against radial flange 26.

A coupling nut 30 having an internal radial shoulder 31 is rotatably carried on the plug connector 20 and positioned by a retaining ring 32. Radial shoulder 31 is captivated for rotation between retaining ring 32 and radial flange 26. To compensate for axial loads and other disturbances, a waved washer 34 is provided adjacent to radial shoulder 31 to bias the nut rearwardly and shield ring 40 forwardly. The coupling nut has its forward end 33 provided with internal helical ramps 35 which threadably engage with a bayonet-type pin 15 which extends outwardly from the receptacle shell.

FIG. 2 is an enlarged view in section of shield ring 40 mounted to plug shell 22. The phantom lines show the forward portion of the receptacle shell 12 being fit about the forward portion of the plug shell. The primary alignment key 29 is fits within alignment groove 19 to register the connector members and allow only permitted connectors to be assembled.

Preferably and in accord with this embodiment of the invention, shield ring 40 is of resilient metal and comprises an annular band 42 having an outer rim 43 and an inside diameter 41 (i.e., inner opening), shown best in FIG. 3, with a plurality of convexly curved fingers 44 extending perpendicularly from outer rim 43, the inner opening 41 of annular band 42 being sized to clearance fit about the outside diameter (i.e., exterior) of the plug shell. When shield ring 40 is mounted to the plug shell, annular band 42 will circumpose annular groove 28 and abut against flange 26 and the curved fingers 44 will extend over and forwardly of radial flange 26. Convex fingers 44 are of sufficient forward extension relative to flange 26 so that upon mating of the plug and receptacle connector members, the plug shell will be contacted by annular band 42 and the receptacle shell 12 will be connected by the end portions of the fingers. The fingers will flex radially outwardly when contacted by the receptacle shell (flexing not shown). As a result, the shells 12, 22 will be provided with a continuous electrical ground path therebetween.

Preferably and in accord with this invention, a detent portion 46 extends upwardly from annular band 42 and a portion of flange 26 includes a keyway 50 sized to receive and lock detent portion 46 against rotation when fit therein. To position annular band 42 firmly against the flange portion, retaining ring 52 has an internal diameter 57 (i.e. opening) less than the outer diameter of the plug shell and is adapted to snap within annular groove 28. Retaining ring 52, in addition to its retention function, serves to protect the surface of the shield ring band by providing a bearing surface that waved washer 34 bears against when it rotates with coupling nut 30.

FIG. 3 shows shield ring 40 and retaining ring 52 about to be assembled over the rearward end of plug shell 22. Primary key 29 is disposed on the forward end portion of the plug shell and in axial alignment with keyway 50. The shield ring is shown with the convexly curved fingers 44 being radially separated and extending from rim 43 of annular band 42. Detent portion 46 of shield ring 40 includes a pair of end faces 47, 49 which are sized to fit into flange portion keyway 50 when shield ring 40 is mounted to the plug shell 22, keyway 50 having a pair of abutment faces 51, 53 which are adapted to be abutted, respectively, by detent end faces 47, 49.

Preferably and in accord with this invention, retaining ring 52 is diagonally slit at 54 (i.e., has a "bean" cut) therein. This cut, extending between inner diameter 57 and outer diameter 55, allows retaining ring 52 to distort for fitment in annular groove 28 of plug shell 22. More importantly, though, this cut provides a mounting configuration which is such that ring 52 will not bind outwardly and dislocate when waved washer 34 rotates thereover.

FIG. 4 shows (in fragment) shield ring 40 assembled to the plug shell of FIG. 3. Annular band 42 is mounted against flange portion 26 such that detent portion 46 having the spaced end faces 47, 49 are abutting against abutment faces 51, 53 in flange keyway 50. That is, when detent portion 46 is disposed in keyway 50 of radial flange 26, end face 47 abuts against abutment face 53 and end face 49 abuts against abutment face 51 to thereby prevent the shield ring from rotating. Retaining ring 52 is disposed within annular groove 28 to position the shield ring against the flange.

FIG. 5 is an alternate embodiment according to the invention and shows a shield ring 60 being mounted forwardly of radial flange 26 of plug shell 22. In this embodiment, annular groove 28 is not needed and waved washer 34 abuts the radial flange 26. Shield ring 60 includes an annular band 62 having a plurality of convexly curved fingers 64 extending perpendicularly forward from the rim thereof to engage the receptacle shell. As before, a plurality of axially extending alignment keys 27, 29 are disposed about the plug shell. Key 29 is wider than the other keys 27 and is regarded as the master key. In combination, the keys 27, 29 provide a clocking arrangement about the shell which is advantageously used in mounting shield ring 60 to the shell.

FIG. 6 shows the shield ring 60 having an inner diameter 61 (or opening) sized to clearance fit over the forward portion of plug shell 22 (other details such as the coupling nut being omitted for clarity). A number of radial cut-outs 69, 63 extend radially outward from inner opening 61 of annular band 62, the radial cut-outs being oriented so as to register with and fit, respectively over alignment keys 27, 29 disposed around forward end portion of the plug shell. Keys 27, 29 extend axially rearwardly from their forward end faces to their rearward end faces 75 spaced axially from the forward face of radial flange 26. That is, all keys 27, 29 have an axial portion thereof adjacent to flange 26 removed to define a passage or keyway 70 therebetween (see FIGS. 5 or 9). These passages are sized to accomodate annular band 62 when fit therebetween. Key 29 also defines a pair of angularly spaced abutment faces 71, 73. Extending upwardly from annular band 62 are at least two angularly spaced tabs 65, 72. Preferably and in accord with this invention, a third tab 68 is interposed between tabs 65, 72 with each tab being separated from one another or band 62 by a radial slot so as to be free to flex independently of each other relative to its securement to the band. Cut-out 63 forms a radial slot having an end face 62A adjacent to tab 65. As a result of the radial slots, each tab 65, 68 and 72 includes, respectively, angularly spaced radial end faces 65A, 65B; 68A, 68B and 72A, 72B. Initially, cut-outs 63, 69 are clearance fit about keys 29, 27 with end face 62A of cut-out 63 being adjacent abutment face 73 of key 29; end face 65A of tab 65 being adjacent abutment face 71 of key 29; end face 65B facing end face 68A; and end face 68B facing end face 72A.

FIG. 7 shows shield ring 60 and annular band 62 being slightly rotated with tab 65 being deflected by and behind key 29.

FIG. 8 shows shield ring 60 rotated into its final position where tab 65 has advanced just beyond key 29, tab 68 is disposed in passage or keyway 70 formed between key 29 and the radial flange portion and tab 72 has advanced so as to be just before key 29.

FIG. 9 is a plan view of shield ring 60 mounted to the plug shell. End face 65B of first advancing tab 65 abuts against abutment face 73 of key 29 and end face 72A of the third tab 72 abuts against abutment face 71 of key 29. First and third tabs 65, 72 serve to lock with key 29 to prevent shield ring 40 from rotating. The end of tab 68, shown partially in fragment, is captivated in the keyway 70. The leading edge of tab 68 is shown contacting axial face 75 of key 29. Preferably and in accord with this invention, the leading edge of band portions between slots 63 would be adapted to bias against axial face 75 of keys 27 (not shown). The spaced tabs coact to prevent the band from rotating. The leading edges of the band bias the ground ring against the flange.

OPERATION

Returning to FIGS. 1–4, for mounting the shield ring 40 to the plug shell, shield ring 40 would be clearance fit over the rear portion of the connector 20 and brought forwardly and into abutment with the radial flange portion 26. The ring would be rotated as needed to fit detent portion 46 into keyway 50 in radial flange 26 and the annular band 42 positioned thereagainst. The retaining ring 52 would then be brought forwardly over the rear end portion of the plug shell 22 and fitted into annular groove 28, thereby mounting the shield ring to the plug shell.

Returning to FIGS. 5–9, shield ring 60 is inserted over the forward end of the plug shell and oriented therewith by registering cut-outs 69, 63 of annular band 62 with polarizing keys 27, 29 disposed on the outer surface of the shell. The appropriate cutout portions on the shield ring annular band allow the band to be clearance fit over and keyed onto the shell. Passages between the keys and flange define a keyway 70 within which annular band 62 may be rotated. As shield ring 60 is rotated, in this case clockwise, the first resilient tab 65 is deflected behind key 29 (see FIG. 7). Continued rotation causes first tab 65 to advance behind key 29 and snap forward, the intermediate tab 68 to be deflected behind and captivated within keyway 70 and second tab 72 to be abutted against the key. The end faces 65B, 72A, respectively, on tabs 65, 72 abut the abutment faces 71, 73 on the axially extending key 29 to prevent rotation of the shield ring relative thereto.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

I claim:

1. An electrical connector (20) of the type including a cylindrical shell (22) having a radial flange portion (26) and an axial key portion (29) and an RFI/EMI shielding ring (60) sized to fit over the shell to mount adjacent to the flange portion, the connector characterized by:

said key portion (29) having an end face (75) and first and second radial abutment faces (71, 73), the end face (75) being spaced axially from the front face of flange portion (26) to define a passageway (70) therebetween;

said shielding ring (60) having an annular band (62) including a pair of radial tabs (65, 72) having adjacent radial end faces (65B, 72A), respectively, defining a detent portion therebetween, such that when the detent portion is fit about the key portion (29), one of said radial end faces (65B) abuts said first radial abutment face (73) and the second of the said radial end faces (72A) abuts said second radial abutment face (71);

the abutting of said radial faces preventing the shield ring from rotating relative to the flange.

2. The electrical connector as recited in claim 1 wherein said annular band comprises a third radial tab (68), said third tab being intermediate said pair of radial tabs (65, 72) with each of said radial tabs extending upwardly from the plane of said annular band and being independently resiliently deflectable, said third radial tab (68) having its end biasing against the end face (75) of the key (29).

3. An electrical connector (20) of the type including a cylindrical shell (22) having a radial flange portion (26) and a longitudinal key portion (29) extending therefrom, a dielectric insert (23) mounted in the shell, an electrical contact (24) supported in the insert for mating and a shield ring (40) formed of resilient metal for shielding the contact from EMI RFI and including a flat annular band (42) having convexly curved fingers (44) extending transversely from the outer rim (43) of the band, and means for mounting the shield ring to the shell, said mounting means being solderless and characterized by:

a locking keyway (50) disposed on the flange portion;

means (52) for retaining the shield ring on the shell and for positioning the annular band against the flange portion, said shield ring being sized to fit over the shell; and detent means (46) cooperative with said keyway for preventing said shield ring from rotating relative to said flange portion.

4. The electrical connector as recited in claim 3 wherein said rotation preventing means includes said annular band having a detent portion (46) raised upwardly therefrom, said detent portion being sized to fit within the locking keyway (50), whereby said shield ring may be properly oriented on the shell and, when the detent is positioned flush against the flange portion, rotation of the shield ring is prevented.

5. In an electrical connector assembly (100) comprising a pair of connector members (10, 20) including interfittable shells (12, 22) having contacts (14, 24) therein which engage upon axial mating of said shells along the center axis thereof, a coupling ring (30) for connecting the members together in the mated position, one of said shells (22) having a radially extending flange portion (26), means (40) for shielding the contacts from RFI/EMI, said shield means being formed of resilient metal and comprising an annular band (42) having convexly curved fingers (44) extending therefrom, means (34) for biasing the coupling ring from the flange, and means (52, 46) for mounting and positioning the shield means to said one connector shell, the mounting means being solderless characterized by:

a continuous annular recess (28) disposed around and circumjacent to the flange portion (26) of said shell (22);

a flat retaining ring (52) including an opening sized to be clearance fit within the annular recess, said retaining ring (52) positioning the annular band (42) of the shield ring (40) against the radial flange portion (26) and having a transverse cut (54) extending from the inner opening to the rim;

a keyway (50) disposed in said flange portion (26);

a detent portion (46) formed in said annular band portion which engages with the keyway (50) disposed in the annular flange whereby retention of said shield ring in said recess and fitment of said detent in said keyway will prevent the shield ring from rotating within the recess.

6. An electrical connector (20) of the type including a shell (22) having an outer surface, a dielectric insert (23) mounted in the shell, an electrical contact (24) supported in the insert for mating and a shield ring (60) formed of resilient metal for shielding the contact, the shell including a radial flange portion (26) and a longitudinal key portion (29), the shield ring (60) comprising an annular band (62) having convexly curved fingers (64) extending therefrom, the connector characterized by:

a passageway (70) axially separating the flange portion (26) from the key portion (29); and said annular band including means (63) for registering the shield ring (60) relative to the key (29) and means (65, 72) for locking the band relative to key (29) whereupon the annular band disposed in passageway (70) may be rotated from a first registered position to a second position wherein the shield ring is locked in position on the connector shell.

7. The electrical connector as recited in Claim 6 wherein said registering means comprises a cut-out (63) sized to clearance fit about said key (29) and said locking means comprising a spaced pair of tabs (65, 72) defining a detent therebetween, said key (29) having abutment faces (71, 73) and said tabs (65, 72) including, respectively, radial end faces (65B, 72A) which abut against the abutment faces to lock the shield ring to the key.

* * * * *